US005266098A

United States Patent [19]

Chun et al.

[11] Patent Number: 5,266,098

[45] Date of Patent: Nov. 30, 1993

[54] PRODUCTION OF CHARGED UNIFORMLY SIZED METAL DROPLETS

[75] Inventors: Jung-Hoon Chun, Sudbury; Christian H. Passow, Cambridge, both of Mass.

[73] Assignee: Massachusettes Institute of Technology, Cambridge, Mass.

[21] Appl. No.: 817,517

[22] Filed: Jan. 7, 1992

[51] Int. Cl.[5] ..... B22F 9/08

[52] U.S. Cl. ..... 75/335; 75/338; 75/340; 264/10

[58] Field of Search ..... 75/331, 335–340; 264/10

[56] References Cited

U.S. PATENT DOCUMENTS 4,762,553 8/1988 Savage et al. ..... 75/338
4,886,547 12/1989 Mizukami et al. ..... 75/334
5,062,936 11/1991 Beaty et al. ..... 75/336

FOREIGN PATENT DOCUMENTS 1587125 4/1981 United Kingdom ..... 75/336

*Primary Examiner*—George Wyszomierski
*Attorney, Agent, or Firm*—Robert F. O'Connell

[57] ABSTRACT

A process for producing charged uniformly sized metal droplets in which a quantity of metal is placed in a container and liquified, the container having a plurality of orifices to permit passage of the liquified metal therethrough. The liquified metal is vibrated in the container. The vibrating liquified metal is forced through the orifices, the vibration causing the liquified metal to form uniformly sized metal droplets. A charge is placed on the liquified metal either when it is in the container or after the liquified metal exits the container, the charging thereof causing the droplets to maintain their uniform size. The uniformly sized droplets can be used to coat a substrate with the liquified metal.

19 Claims, 3 Drawing Sheets

PRODUCTION OF CHARGED UNIFORMLY SIZED METAL DROPLETS

This invention was made with government support under grant Number DDM-9011490 awarded by the National Science Foundation. The government has certain rights in the invention.

BACKGROUND OF THE INVENTION

The production of metal droplets is useful in a variety of research and commercial applications. Such applications include metal powder production, rapid solidification research, spray forming of discrete parts, spray forming of strips, spray forming of metal-matrix composites and metal coating. In carrying-out these applications, there are a variety of methods used to produce the metal droplets such as atomization of molten metal by gas jets or by high pressure water, spraying molten metal onto a spinning disc (melt spinning) or into a vacuum to form discrete particles, vaporization of metal in a vacuum followed by condensation, fusion of metal in a vacuum followed by condensation, fusion of metal by an electric arc followed by the formation of droplets which are forced out of the arc zone, and forming a molten surface on a metal rod and agitating the metal at an ultrasonic frequency.

Another technique to generate metal droplets, particularly for research purposes, is electrohydrodynamic (EHD) spraying. The EHD technique comprises the use of a very intense electric field at the tip of a capillary tube through which molten metal flows. The electrostatic stresses applied by the electric field at the tip of the small capillary tube result in a highly dynamic process at the charged liquid surface, resulting in charged droplet formation. EHD processes and variations thereto are disclosed in U.S. Pat. No. 4,264,641 and "Application of Electrohydrodynamic to Rapid Solidification of Fine Atomized Droplets and Splats," Perel et al, Mar. 23–26, 1980, at the Conference on Rapid Solidification Processing, Principles and Technologies, II, Reston Va.

While each of these known processes have their advantages and have achieved varying degrees of success, none of them is capable of producing with any consistency metal droplets uniform in size, shape, initial velocity, and thermal state.

Ink jet printing processes, while producing uniform liquid droplets, are not concerned with producing charged uniformly sized metal droplets. Also, maintaining a separation between droplets is not a problem or an issue in ink jet printing because the distance from the ink nozzle to the printing surface (paper) is no more than a few centimeters. This is unlike metal droplet processes wherein the distance from droplet formation to the substrate or collector needs to be sufficiently extended for the metal droplets to cool and at least partially solidify. As such the distance generally must be at least about 25 centimeters. At such a distance, droplets in a stream broken from a jet would naturally merge with one another, with the merging destroying any uniformity of initial droplet distribution.

Accordingly, it is an object of the present invention to develop an apparatus and process for producing charged uniformly sized metal droplets. By virtue of the charge, droplets are prevented from merging in flight and thus they can remain uniformly sized until they solidify or are collected on a substrate. Furthermore, the charge on the droplets makes it possible to manipulate the flight of the droplets with externally applied electric fields.

It is another object of the present invention to produce charged uniformly sized metal droplets for use in research and commercial applications.

SUMMARY OF THE INVENTION

Accordingly, the present invention is directed to a process and apparatus for producing and maintaining charged, uniformly sized metal droplets and to the charged uniformly sized metal droplets themselves. As used herein "maintaining" means that the droplets once formed remain uniformly sized until they either solidify or are collected on a substrate.

The process of the present invention requires the use of an apparatus comprising a spray chamber and a droplet generator disposed within the spray chamber for producing charged uniformly sized metal droplets and preferably a monitoring system for monitoring and controlling the droplet formation process. The droplet generator generally comprises a container for holding and liquefying a charge of metal, a forming means for forming uniformly sized metal droplets, and a charging means for charging the metal droplets. The forming means is preferably either a vibrating means for vibrating the molten metal in the container or at least one oscillating gas jet disposed outside the container at the point where the liquefied metal exits the container.

The process generally comprises liquefying metal in the droplet generator container which has at least one droplet-forming spray orifice, charging the liquefied metal, and forcing the liquefied metal through the at least one orifice and thereafter forming charged uniformly sized liquid metal droplets which maintain their uniform size.

In one embodiment the liquefied metal is formed into uniformly sized metal droplets by vibrating the liquid metal while it is in the container and forcing it out of an orifice in the container so as to form metal droplets. As the liquefied metal exits the at least one orifice as a jet, the imposed vibrations in the liquefied metal cause it to break up into uniformly sized metal droplets. In an alternative embodiment at least one oscillating gas jet is positioned at the exit point of the liquefied metal from the container to create the uniformly sized metal droplets.

In both of these embodiments, the metal droplets may be charged by either charging the liquefied metal while it is in the container or by charging the droplets as or after they are formed after exiting the container.

After the metal droplets are formed, they continue their descent through the spray chamber to a collecting means such as a substrate. The end use application of the metal droplets will, of course, determine the composition of the droplets and the substrate. The substrate may include a powder collection container, a metal or ceramic plate for producing deposits, a half-mold for producing shapes, a roller for producing sheets, a wire, a part to be coated, and a metal sheet.

The metal droplets formed using the process and apparatus of the present invention are in each case of uniform size and shape; i.e. they are substantially spherical in shape and have diameters which vary in degree by no more than about ±25%, preferably by no more than about ±10%, still more preferably by no more than about ±5%, still more preferably by no more than about ±3%, and most preferably by no more than about ±1%. The metal droplets are formed having this uniformity without the need for any size classification procedures. As used herein "metal droplets" includes both liquid and solid metal droplets. The process of the present invention is capable of producing metal droplets having diameters which may be controlled to be within the range of from about 10 to 500 micro-meters (μm), depending upon the specific process conditions employed.

The process and apparatus of the present invention are useful in numerous end use applications including uniform powder production, rapid solidification research, spray forming of discrete parts, spray forming of strips, spray forming of metal matrix composites, and metal coating.

DETAILED DESCRIPTION OF THE PREFERRED EMBODIMENTS

Figure 1:
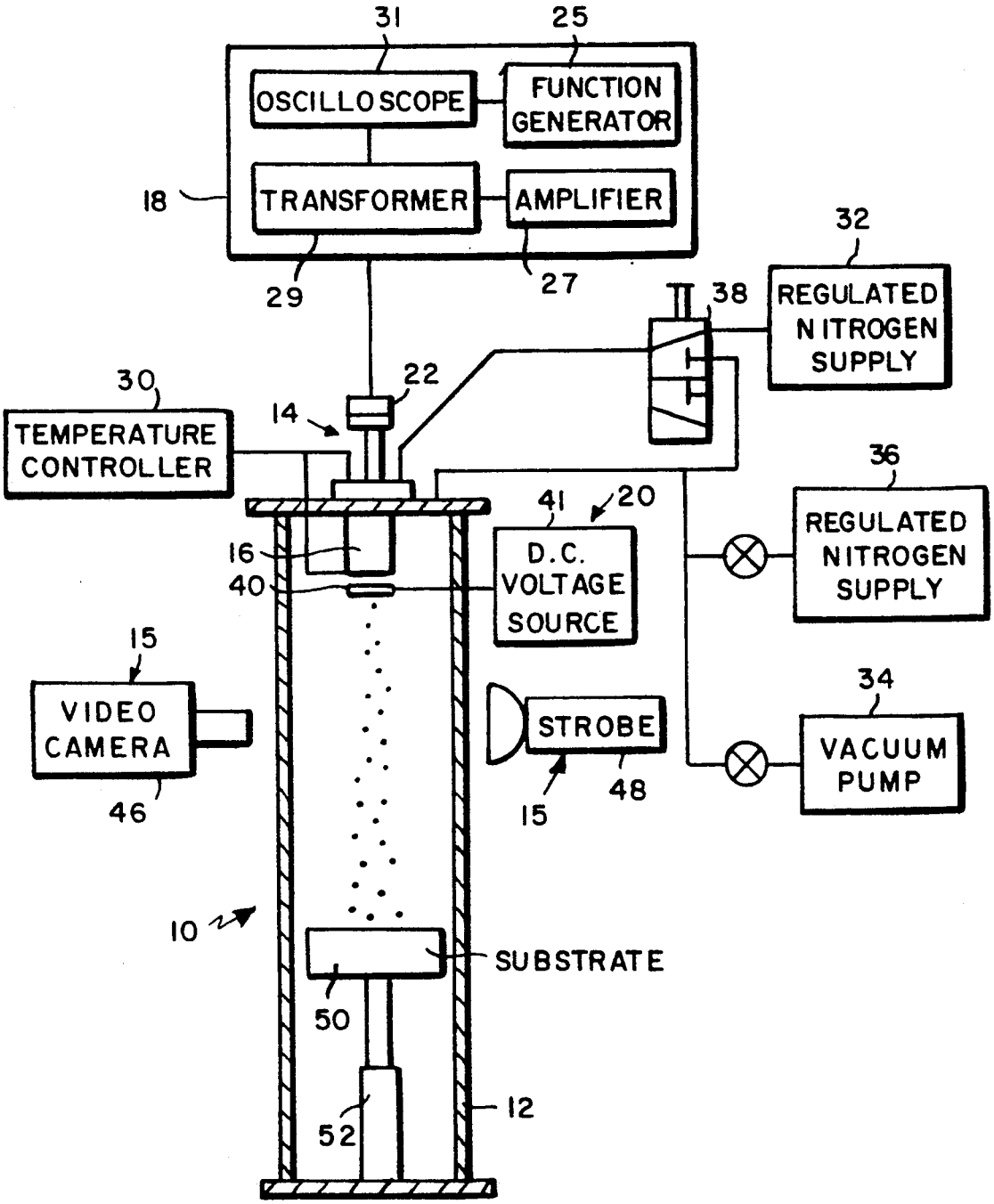
FIG. 1 is a cross-sectional view of the first embodiment of the metal droplet formation apparatus of this invention.

Referring now to the drawings, the process and apparatus for use in carrying out the process will now be described.

Figure 2:
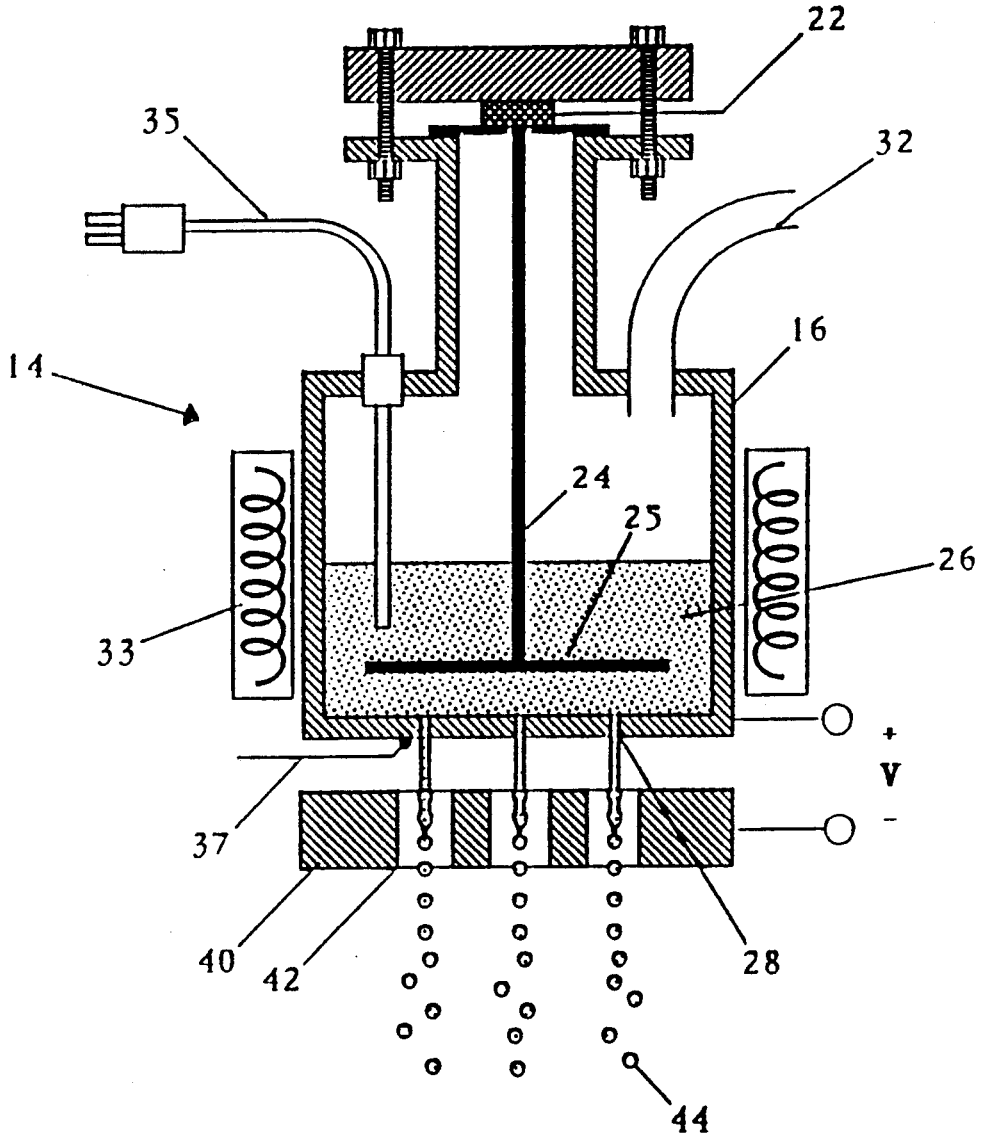
FIG. 2 is a cross-sectional view of the metal droplet generator of the apparatus of FIG. 1.

As shown in FIG. 1, a droplet formation apparatus 10 generally comprises a spray chamber 12, a droplet generator 14, and a monitoring system 15. As best shown in FIG. 2, the droplet generator 14 generally comprises a container 16, a vibrating means shown generally as member 18, and a charging system 20. The vibrating means 18 comprises a function generator 25, an amplifier 27, a transformer 29, an oscilloscope 31, and a piezoelectric transducer 22, such as a lead metaniobate piezoelectric transducer, connected to a shaft 24 and disk 25 which extends into container 16 and into a liquefied metal 26. The vibrating means produces small, regular oscillations through the orifices 28 that break the jet of liquefied metal being forced through the orifices into uniform metal droplets as the metal jets exit the orifices. The metal droplets then pass through a charging plate 40 with a suitable opening for each jet or set of jets. The charging plate 40 is positioned at about the point where the jets of metal break into individual droplets. The function generator, amplifier, and transformer drive the piezo with up to about 300 volts at about 1 to 100 kHz. At this voltage, a 3.2 mm thick lead metaniobate piezo transducer vibrates with an amplitude of about 0.1 μm. Any piezo transducer which will produce vibrations of a similar magnitude may be used. The vibrations are transmitted down the shaft 24 through the disk 25 and into the liquefied metal 26. The shaft protects the piezo from the heat of the liquefied metal 26 and the vibrations transmitted through the liquefied metal cause the metal jets to break into uniform droplets as they exit the spray orifices 28. In order for the piezo to operate it must be maintained sufficiently below its Curie temperature so that it does not de-pole and lose its piezo-electric characteristics that enable it to vibrate. The length of the shaft therefore depends upon the temperature of the molten metal in the container and on the Curie temperature of the piezo-electric crystal. Typically, the shaft will extend about 10 cm above the molten metal. In an alternative embodiment (not shown) the piezo transducer based vibrating means may be replaced by an electro-mechanical agitator.

The container 16 is constructed of a suitable material for holding molten metal such as, for example, a higher melting point metal like stainless steel or a ceramic such as fused silica, graphite, or alumina. The container is provided with an air tight seal (not shown) at its top such as a knife edge rim against a soft copper gasket. The bottom of the container 16 has at least one, but preferably a plurality of orifices 28 through which liquefied metal 26 is forced as jets. While any suitable material may be used to form the orifices 28, they are preferably drilled in sapphire or ruby jewels such as those supplied by Bird Precision of Waltham MA. Preferably, they have length to diameter ratios of about one, polished inner diameters, and sharp, burr-free edges. The orifice jewels are mounted in pockets on the bottom of the container, preferably with a high temperature ceramic adhesive. Depending upon the end use of the metal droplets, the orifice sizes and number of orifices may be varied. For example, for spray characterization experiments only a single orifice need be used. For spraying deposits, a grid orifice having up to about 100 individual orifices can be used to create high mass fluxes. Orifice diameters may range from about 25 to 250 μm. An orifice with a diameter of 50 μm can produce droplets having diameters of from about 80 to 110 μm. An orifice with a diameter of 75 μm produces droplets having diameters of from about 120 to 165 μm. An orifice with a diameter of 100 μm produces droplets with diameters of from about 160 to 220 μm. The exact size of the droplets produced is a function of the jet diameter (d), the jet velocity (V), and the frequency of the imposed vibrations (f). The jet diameter (D) is determined primarily by the orifice diameter but also is a function of the jet velocity. The general relationship among these parameters is:

$$D = \sqrt[3]{\frac{3\,d^2\,V}{2f}}$$

Associated with the container 16 is a temperature control system 30 which includes a heating means 33 for melting the metal 26 within the container 16. While any suitable temperature control system may be employed, as shown in FIG. 2, it is presently preferred to employ a system comprising two 300 watt resistance band heaters, two thermocouples 35 and 37 (one in the melt 26 and one at an orifice 28), a digital temperature controller (not shown) and a temperature display (not shown).

Associated with both the droplet generator 14 and the spray chamber 12 is a pressure and atmospheric control system. As best shown in FIG. 1, the pressure control system controls the atmosphere in the spray chamber 12 and forces liquefied metal from the container 16 through the orifices 28. The system comprises two regulated gas supplies 32 and 36, a vacuum pump 34 and a three-way valve 38 that connects the container 16 to either the spray chamber 12 or one of the pressure sources 32. The other pressure source 36 and the vacuum pump 34 are connected directly to the spray chamber 12. The presence of oxygen in the spray chamber hinders and may prevent the formation of the metal droplets. Accordingly, the atmosphere within the spray chamber and the container is substantially oxygen-free.

To accomplish this, the apparatus is evacuated and flushed with an inert gas such as nitrogen, argon, or helium before being operated. The inert gas atmosphere is maintained during use.

A pressure differential across the orifices 28 between the container and spray chamber of at least about 5 psi is required to form a jet of liquefied metal. A pressure differential of between about 20 and 100 psi is preferred. To avoid producing a jet prematurely, container 16 is connected to the spray chamber 12 during the oxygen evacuation and flushing procedure prior to use. This equilibrates the pressure in the spray chamber and the container 16. Then, to create a liquid jet, the three-way valve 38 is turned to the pressure source 32 to produce the desired pressure differential needed to produce a liquid jet.

The droplet charging system 20 generally comprises a charging plate 40 having holes 42 which are aligned with the orifices 28 to permit the flow of metal droplets 44 therethrough and a voltage source 41. The plate 40 is preferably made of a highly conductive metal such as brass, copper, steel or aluminum and is about 1 to 50 mm thick. The holes 42 are generally of from about 1 to 25 mm in diameter. The charging plate 40 is typically about 25 to 100 times as thick as the diameter of the orifices 28 and the diameter of the holes 42 is typically about 10 to 50 times the diameter of the orifices. The charging plate is positioned so that the jets from the orifices break into droplets as they pass through the holes in the plate. When the plate 40 is held at a voltage with respect to the liquid jet, the combination of this voltage and the capacitance between the plate and jet brings a charge to the section of the jet passing through the holes 42. As each droplet 44 breaks from the jet stream, it retains a portion of the charge. With charging, the droplets repel each other in flight and scatter into a cone shape as they fall towards the substrate 50. The amount of scatter can be controlled by varying the charging voltage.

The monitoring system 15 comprises a CCD video camera 46 with a microscopic zoom lens and a strobe-light 48 that is synchronized with the piezo driving signal. The monitoring system may also include a second strobe for measuring droplet velocities which can be of importance for certain applications such as spray forming and coating. The monitoring system takes real-time pictures of the droplet stream. These picture provide feedback that allows an operator to control droplet size and to adjust the pressure differential and vibration frequency to avoid satellite droplet formation.

The spray chamber 12 is an air-tight sealed chamber which maintains a substantially oxygen-free atmosphere which is beneficial for proper droplet formation. The spray chamber 12 is made from any suitable, preferably translucent, material including acrylic and glass.

The substrate 50 used in this embodiment to collect the metal droplets may be made from any suitable material including metal, ceramic, and glass. The substrate may also be connected with a heating/cooling system (not shown) and a height adjustment mechanism 52 for adjusting the height of the substrate in the spray chamber 12.

In operation, the process using the apparatus of FIGS. 1 and 2 is carried out by first inserting metal material in the form of chips, ingots, or shot into the container 16. Any suitable metals such as tin, zinc, lead, aluminum, titanium, iron, nickel, as well as mixtures or alloys thereof may be used depending upon the end use application. The container and spray chamber are then sealed and flushed with an inert gas such as $N_2$, Ar or He to remove the oxygen. The container and metal material are then heated until the metal material melts and the temperature is then maintained at or above the melting temperature of the particular metal material. The function generator 25, amplifier 27, transformer 29 and oscilloscope 31 are then turned on to apply a signal of from about 100 to 300 volts at about 1 to 100 kHz. This signal vibrates the piezo transducer 22 which vibrates the shaft 24 and disk 25 and thus the melted metal. By applying a pressure differential between the container and spray chamber the liquefied metal is forced through the orifice or orifices 28 in the bottom of the container 16. A potential of about 50 to 5000 volts is applied to the charging plate 40 and as the liquefied metal jet passes out of the orifices 28 and through the hole or holes in the charging plate, it breaks-up into uniformly sized droplets which are charged. These metal droplets then continue their descent. The actual charge imparted on each droplet is a function of the diameter of the droplet, the diameter of the hole in the charging plate through which the droplet has passed, and the voltage between the charging plate and the liquid metal jets. A charge on a droplet on the order of $10^{-7}$ coulombs/gram is currently preferred. Depending on the end use, the metal droplets may solidify in flight or remain in a semiliquid or liquid state at the point they reach the substrate or collecting surface.

As defined herein uniformly sized metal droplets means that the droplets produced under defined process and equipment conditions, are substantially spherical in shape and vary in diameter by not more than about $\pm 25\%$, preferably by not more than about $\pm 10\%$, still more preferably by not more than about $\pm 5\%$, still more preferably by not more than about $\pm 3\%$, and most preferably by not more than about $\pm 1\%$. This process and apparatus is capable of producing metal droplets having sizes ranging from about 10 to 500 micro-meters in diameter.

Figure 3:
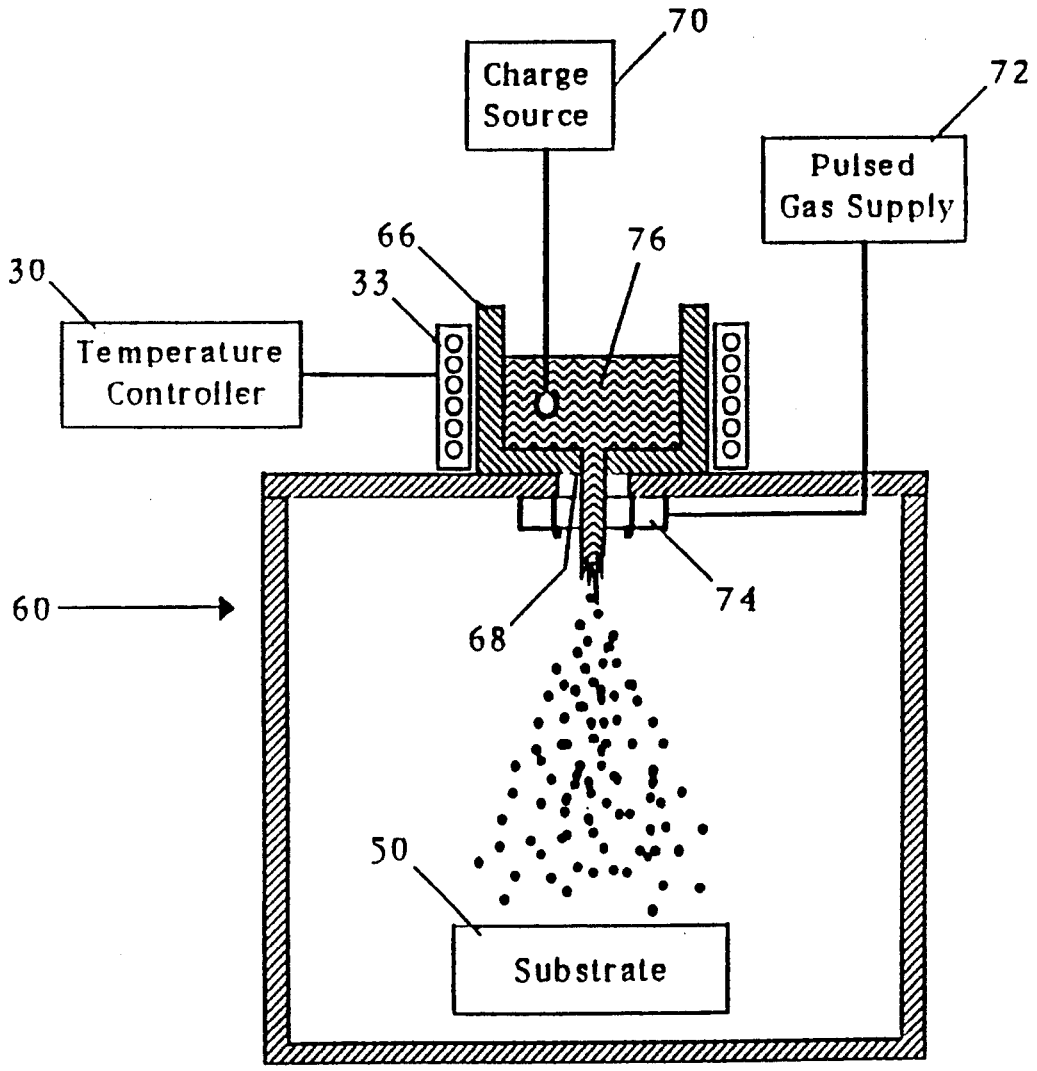
FIG. 3 is a cross-sectional view of the second embodiment of the metal droplet formation apparatus of the present invention.

An alternative embodiment of the present invention is shown in FIG. 3. In this embodiment like parts have the same reference numerals as in the embodiment of FIGS. 1 and 2. Such parts function in the same or similar manner. As shown, the charged metal droplet apparatus 60 comprises a container 66 having a temperature controller 30 and heating elements 33 for liquefying the metal 76 within the container 66. Unlike the embodiment of FIGS. 1 and 2, the charge is applied to the metal before it is formed into droplets by charging the liquefied metal 66 in the container using charging means 70. A suitable charging means would be a Van de Graaff generator.

Like the container of FIG. 2, container 66 has an orifice 68. Although only one spray orifice is shown, the container may have a plurality of spray orifices. The orifices are produced of the same materials as the orifices of the container of FIG. 2 and have diameters of about 2 and 10 mm. As the liquefied metal 76 is forced out of the container 66 through the orifice 68 it is subjected to oscillating gas jets 74 of an inert gas such as nitrogen, argon or helium. The gas jets 74 oscillate at a frequency of from about 1 to 500 kHz. A pulsed gas supply 72 is fed to the gas jets 74. The gas has a velocity between about 50 and 1,000 m/sec. The jet of liquid metal, once contacted by the oscillating gas jets which result in gas pulses, breaks up into a narrow distribution of metal droplets that is narrower than the distributions which are generated by conventional gas atomization techniques which do not use the oscillating gas jets. The spray chamber also contains a substrate 50 for the collection of the metal droplets.

Alternatively, either the metal droplet forming procedure using pulsed gas atomization may be used with a charging plate or the metal droplet forming procedure using vibratory means may be used with a charging of the liquefied metal in the container, i.e. before forming droplets of the metal.

The charged uniformly sized metal droplet apparatus and process of the present invention may be used in for a variety of different commercial and research applications. They are useful in the production of uniformly sized metal powders. With the apparatus and process of this invention, no seiving or other size classification procedures are required to obtain uniformly sized powders. The apparatus of the present invention is also useful in rapid solidification research on a droplet source that can be controlled to repeatedly produce droplets having specified diameters, initial velocities and thermal states. The apparatus can be used to produce single droplets by either selectively charging a single droplet and deflecting it or by charging all the droplets in a stream but one and then deflecting away the unwanted charged droplets.

The apparatus can also be used to perform fundamental experiments on spray forming that will explain how different droplet impact states determine process yield and the porosity and microstructure of sprayed deposits. In addition the apparatus can be used to seek distributions of droplets that can be produced by processes that are more efficient than gas atomization, but that produce deposits of the same or better quality as gas atomized sprays. By arranging the device's orifices in a line or long array, the apparatus can be used for the spray forming of metal sheets. It is difficult to spray form sheets with current spray forming techniques (that produce gaussian mass-flux distributions) because sheets must be nearly flat to be rolled. In conjunction with a device that sprays oppositely charged ceramic particles, the apparatus of the present invention can be used to spray form metal-matrix composites with excellent reinforcement distribution. The droplets and reinforcements attract each other in flight and produce a more homogeneous distribution than can be produced by random mixing.

The apparatus can be used to deposit uniform metal droplets onto a surface. Metal coating with this device may prove to be an effective method for applying metal coatings that have uniform properties and that are uniformly thick.

The apparatus and process of the present invention will now be described with reference to the following examples, which are illustrative of one of the embodiments of the present invention.

EXAMPLE I

Using an apparatus substantially as shown in FIGS. 1 and 2, chips of tin metal (500 g) were placed in a 304 stainless steel container. The tin was heated to a temperature of 300° C. to melt it. The tin was maintained at this temperature for the duration of the process. The spray chamber (a cast acrylic tube) and container were both flushed with $N_2$ gas and an atmosphere of substantially pure $N_2$ gas was maintained in both. A pressure differential of 40 psi was built up between the container and the spray chamber forcing the tin through a single orifice of a sapphire jewel (100$\mu$ in diameter) in the bottom of the container. At the same time, a function generator, amplifier, and transformer drove a lead metaniobate piezo-electric transducer with 300 volts at 15 kHz. At these conditions, the 3.2 mm thick crystal vibrated with an amplitude of $10^{-7}$ m. These vibrations were transmitted down the shaft through the disk and into the tin. The piezo crystal was positioned 20 cm away from the tin melt.

The jet of tin passed through the orifice in the bottom of the container and through a hole (3.2 mm in diameter) in a 6.4 mm thick charge plate positioned 2 mm below the bottom of the container. The charge plate was made of brass and was 5 cm in diameter. The charge plate was held at a potential of 400 volts with respect to the jet of tin. As the jet of tin passed through the hole in the charge plate it broke up into uniformly sized metal droplets which became charged and held a charge of $10^{-12}$ Coulombs. The droplets fell 1.5 m to a glass substrate whereon they were collected. The droplets were solid when they contacted the substrate.

The diameters of the metal droplets were measured and were found to be 190±5 $\mu$m. The droplets had an initial velocity of 9 m/sec. The droplet diameters were measured using a microscope and micrometer table. It is believed that the actual droplet diameter distribution is actually smaller than that stated, but the method of determining the diameters is not capable of proving this. The initial velocity of the droplets was determined by measuring the spacing between the droplets with a CCD video camera with a microscopic zoom lens and multiplying by the frequency at which the droplets were formed. The droplet formation frequency was assumed to be the frequency at which the piezo was driven.

EXAMPLE II

The procedure of Example I was repeated except that the vibration frequency was changed to 20 kHz. This caused the resultant charged metal droplets to have a diameter of about 170 $\mu$m, ±5 $\mu$m.

EXAMPLE III

The procedure of Example I was repeated except that the orifice diameter was changed to 45 $\mu$m and the vibration frequency was changed to 25 kHz. This caused the resultant charged metal droplets to have a diameter of about 100 $\mu$m, ±3 $\mu$m.

EXAMPLE IV

The procedure of Example I was repeated except that the orifice diameter was changed to 45 $\mu$m and the vibration frequency was changed to 30 kHz. This caused the resultant charged metal droplets to have a diameter of about 94 $\mu$m, ±3 $\mu$m.

What is claimed is:

1. A process for producing and maintaining charged uniformly sized metal droplets comprising the steps of:

(1) liquefying a quantity of metal disposed in a container having at least one orifice to permit the passage of metal;

(2) vibrating the liquefied metal in said container; and (3) forcing the vibrating liquefied metal through the at least one orifice;

said method further including a step of placing a positive or negative charge on the liquefied metal, either before or after it exits the at least one orifice, the vibration thereof thereby causing said liquefied metal to form uniformly sized liquid metal droplets, which droplets exhibit a degree of variation of less than about ±25% from the average droplet diameter, and the charging thereof causing said droplets to maintain their uniform size.

2. The process of claim 1, wherein said vibrating step includes applying at least one oscillating gas jet to the liquified metal as it exits the at least one orifice.

3. The process of claim 1, wherein the liquefied metal is charged after it exits the at least one orifice in the container.

4. The process of claim 3, wherein the placing of a positive or negative charge on the liquefied metal comprises using a charging plate having at least one opening therein aligned with the at least one orifice so as to permit the vibrated liquefied metal exiting the orifice to pass through the charging plate and become charged.

5. The process of claim 4, wherein the liquefied metal is forced through a plurality of orifices forming a plurality of streams of uniformly sized metal droplets and passing the droplets through a plurality of openings in the charge plate thereby forming a plurality of streams of charged uniformly sized metal droplets.

6. The process of claim 3, wherein the uniformly sized droplets have a diameter which is within the range of from about 10 to 500 μm and wherein the droplets exhibit a degree of variation of about ±5% of the average droplet diameter.

7. The process of claim 3, wherein said vibrating step includes applying at least one oscillating gas jet to the liquified metal as it exits the at least one orifice.

8. The process of claim 7, wherein the placing of a positive or negative charge on the liquefied metal comprises using a charging plate having at least one opening therein aligned with the at least one orifice so as to permit the liquefied metal exiting the orifice to pass through the charging plate.

9. The process of claim 7, wherein the uniformly sized droplets have a diameter which is within the range of from about 10 to 500 μm and wherein the droplets exhibit a degree of variation of about ±10% of the average droplet diameter.

10. The process of claim 1, wherein the liquefied metal is charged when it is in the container before it is formed into droplets.

11. The process of claim 10, wherein said vibrating step includes applying at least one oscillating gas jet to the liquified metal as it exits the at least one orifice.

12. The process of claim 10, wherein the uniformly sized droplets have a diameter which is within the range of from about 10 to 500 μm and wherein the droplets exhibit a degree of variation of about ±5% of the average droplet diameter.

13. The process of claim 1, wherein the process further comprises depositing the charged droplets onto a substrate.

14. The process of claim 1, wherein the uniformly sized droplets have a diameter which is within the range of from about 10 to 500 μm and wherein the droplets exhibit a degree of variation of about ±5% of the average droplet diameter.

15. The process of claim 1, wherein the uniformly sized charged metal droplets have an initial velocity of from about 1 to 25 m/sec.

16. The process of claim 1, wherein the uniformly sized metal droplets are charged to about $10^{-5}$ to $10^{-8}$ Coulombs per gram.

17. The process of claim 1, further comprising applying an electric field in a flow path of the metal droplets to change their trajectories.

18. The process of claim 1, further comprising monitoring the charged metal droplets after formation to determine the sizes and the velocities of said liquid metal droplets.

19. The process of claim 1, wherein the process is performed in an inert gas atmosphere.

* * * * *